US006302009B1

(12) United States Patent
O'Quinn et al.

(10) Patent No.: US 6,302,009 B1
(45) **Date of Patent: *Oct. 16, 2001**

(54) GUN NOISE AND RECOIL SUPPRESSOR

(76) Inventors: Carl L. O'Quinn, 8167 Lowell Valley Dr., Bahama, NC (US) 27503; Raymond W. Andrews, Jr., 6911 Bill Poole Rd., Rougemont, NC (US) 27572

( * ) Notice: Subject to any disclaimer, the term of this patent is extended or adjusted under 35 U.S.C. 154(b) by 0 days.

This patent is subject to a terminal disclaimer.

(21) Appl. No.: 09/505,102

(22) Filed: Feb. 16, 2000

Related U.S. Application Data

(63) Continuation-in-part of application No. 08/976,384, filed on Nov. 21, 1997, now Pat. No. 6,079,311.

(51) Int. Cl.[7] ..... F41A 21/00
(52) U.S. Cl. ..... 89/14.4; 42/79
(58) Field of Search ..... 89/14.4; 42/79, 42/76

(56) References Cited

U.S. PATENT DOCUMENTS

| | | | | |
|---|---|---|---|---|
| 37,193 | | 12/1862 | Alsop | 89/14.4 |
| 1,013,974 | | 1/1912 | Vandenbossche | 89/14.4 |
| 1,017,003 | | 2/1912 | Kenney | 89/14.4 |
| 1,111,202 | | 9/1914 | Westfall | 89/14.4 |
| 1,140,578 | | 5/1915 | Coulombe | 89/14.4 |
| 1,173,687 | * | 2/1916 | Thompson | 89/14.4 |
| 1,229,675 | * | 6/1917 | Thompson | 89/14.4 |
| 1,341,363 | | 5/1920 | Fiala | 89/14.4 |
| 1,401,667 | | 12/1921 | Brown | 89/14.4 |
| 1,427,802 | | 9/1922 | Goodwin | 89/14.4 |
| 1,487,214 | | 3/1924 | Dezendorf | 89/14.4 |
| 1,487,312 | | 3/1924 | Bull | 89/14.4 |
| 2,448,382 | | 8/1948 | Mason | 89/14.4 |
| 2,503,491 | | 4/1950 | Janz | 89/14.4 |
| 2,932,915 | | 4/1960 | Wilson | 89/14.4 |
| 2,976,638 | * | 3/1961 | Owens | 89/14.4 |
| 4,008,538 | | 2/1977 | Center | 89/14.4 |
| 4,386,477 | * | 6/1983 | Briley | 42/79 |
| 4,501,189 | | 2/1985 | Brandl et al. | 89/14.4 |
| 4,643,073 | | 2/1987 | Johnson | 89/14.4 |
| 4,833,808 | | 5/1989 | Strahan | 89/14.4 |
| 4,939,977 | | 7/1990 | Stroup | 89/14.4 |
| 5,029,512 | * | 7/1991 | Latka | 89/14.4 |
| 5,157,211 | * | 10/1992 | Mossberg | 42/79 |
| 5,164,535 | * | 11/1992 | Leasure | 89/14.4 |
| 5,317,825 | | 6/1994 | Vatterott et al. | 89/14.4 |
| 5,448,848 | * | 9/1995 | Moller | 42/77 |
| 5,666,756 | * | 9/1997 | Moller | 89/14.4 |

OTHER PUBLICATIONS

Drawing of Vaime Noise Suppressor believed to be from publication by Alan C. Paulson, "Silencer History and Performance".

* cited by examiner

*Primary Examiner*—Charles T. Jordan
*Assistant Examiner*—Denise J Buckley
(74) *Attorney, Agent, or Firm*—Jenkins & Wilson, P.A.

(57) ABSTRACT

A noise and recoil suppressor that is intended to be mounted within the terminal portion of a firearm barrel. The suppressor is a unitary structure having a cylindrical body and a plurality of chambers extending transversely therethrough and spaced-apart in the longitudinal direction of the device. The chambers are configured so as to restrain and slow the passage of the exhausting gases resulting from a bullet that has discharged and passing therethrough so as to suppress both the resulting noise and recoil from the discharging firearm. The suppressor is provided with external threads adjacent its outer end, and a firearm barrel into which the device is to be slidably inserted is suitably drilled-out and provided with internal threads for threadable securement of the device within the end of a firearm barrel. A second and shorter embodiment of the suppressor is disclosed that primarily functions as a recoil suppressor.

3 Claims, 4 Drawing Sheets

GUN NOISE AND RECOIL SUPPRESSOR

RELATED APPLICATION

This is a Continuation-in-Part (CIP) application of Ser. No. 08/976,384, now U.S. Pat. No. 6,079,311, filed Nov. 21, 1997.

TECHNICAL FIELD

The present invention relates to firearms, and more particularly relates to an improved noise and recoil suppressor for firearms.

BACKGROUND ART

As is well known who are familiar with and enjoy firearms, firearms create both a loud noise as well as a significant recoil when they are discharged. The noise and the recoil are generally proportional to the size of the bullets being discharged by the firearms. For example, a 22 caliber rifle produces less noise and recoil than does a high caliber hunting rifle such as a 30-06 caliber firearm. However, both large and small bore weapons generally produce an undesirably great noise and recoil when discharged. This is accurate with respect to almost all firearms including both rifles and pistols.

Previously known firearm noise suppressors, commonly referred to as "silencers", are typically threaded onto the outer end of a firearm barrel in order to reduce the noise of the firearm. These devices have been known for most of this century and all generally directed to muffling or reducing the noise of the exhausting gases created by ignition of a cartridge without necessarily retarding the passage of the bullet through the gun barrel.

Most prior art noise suppressors known to applicants are constructed to effect rapid cooling of exhausting gases and the reduction of pressure therefrom before the gases emerge from the end of the noise suppressor device. Typically, the well-known noise suppressors or "silencers" used on firearms have a large cross-sectional area providing a chamber through which a bullet passes that contains heat absorbing and/or exhaust gas-defusing materials.

Although most noise suppressors are large diameter cylindrical devices that are screwed onto the end of a firearm barrel, it is also known to provide a noise suppressor or silencer along the entire length of an enlarged-diameter rifle barrel. As with the cylindrical devices that are screwed onto the end of a conventional barrel, the full-length large diameter silencers are readily visible to anyone who observes the firearm.

Of interest with respect to this second type of noise suppressor, U.S. Pat. No. 1,487,214 to Dezendorf discloses a rifle wherein the barrel is surrounded by first sleeve and second concentric sleeves. Apertures are provided within the barrel and the first and second concentric sleeves, and the cartridge to be discharged in the firearm is provided with apertures in first and second portions along its length with a partition therebetween. In this manner, when the cartridge is discharged blast gases pass from the rear portion of the cartridge and through the first and second sleeves and back from the sleeves and into the apertures in the uppermost portion of the cartridge in order to propel the bullet projectile from the firearm barrel. Due to the tortuous path through which the blast gases pass in traveling from the explosive chamber of the cartridge and back to the second chamber immediately behind the rear of the bullet projectile, the discharge of the firearm is relatively flashless and noiseless.

Also, U.S. Pat. No. 1,140,578 to Coulombe and U.S. Pat. No. 1,173,687 to Thompson disclose firearm noise suppressors or silencers that extend the entire length of an enlarged diameter rifle barrel and are constructed as an internal part of the enlarged diameter gun barrel.

DISCLOSURE OF THE INVENTION

As can be appreciated, a problem with prior art noise suppressors is that they tend to be relatively large structures that are easily visible to anyone who observes a firearm utilizing such a device. The visibility of the device can be a limitation in certain circumstances. Thus, in accordance with the present invention, applicants have developed a new and improved noise and recoil suppressor that overcomes this shortcoming of prior art silencers and is adapted to be slidably received and secured within the outer end of the barrel of a firearm.

It is therefore an object of the present invention to reduce noise that results from the discharge of a firearm and the exit of the exhausting gases from the end of a firearm barrel.

It is another object of the present invention to reduce the recoil resulting from the discharge of a firearm that is caused by the exhausting gases from the explosion exiting the end of the firearm barrel, and to thereby increase the accuracy of shooting with the firearm.

A still further object of the present invention is to provide a noise suppressor that is mounted inside the end of a firearm barrel and is not visible to the user or other observer of the firearm.

It is yet another object of the present invention to provide a recoil suppressor mounted in the end of a firearm barrel that is not visible to the user or any other person observing the firearm.

Some of the objects of the invention have been stated, other objects will become evident as the description proceeds, when taken in connection with the drawings described below.

BEST MODE FOR CARRYING OUT THE INVENTION

Figure 1:
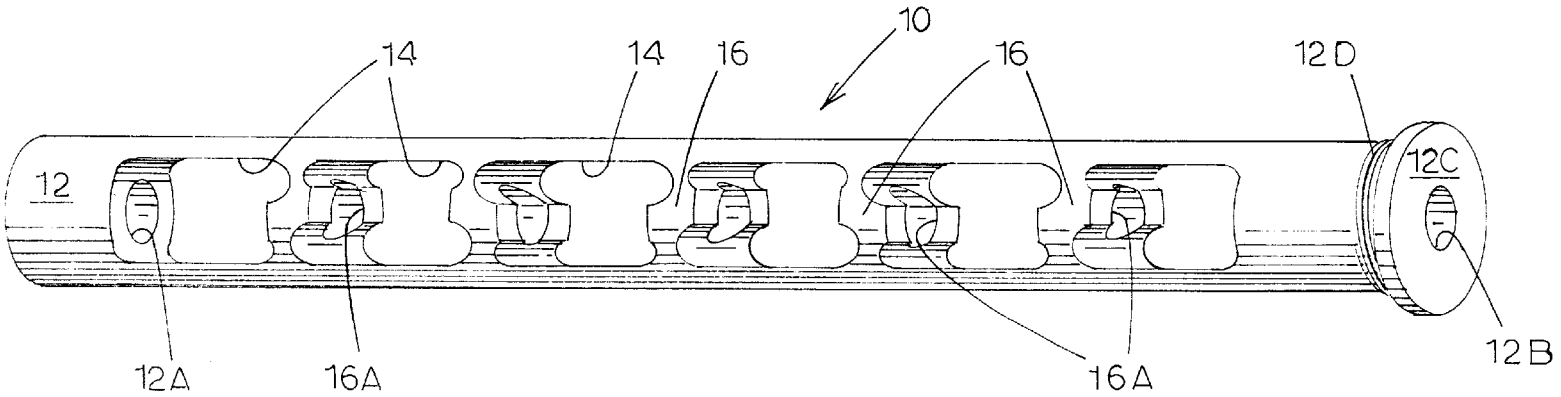
FIG. 1 is a perspective view of a first embodiment of the noise and recoil suppressor of the present invention.
Figure 2:
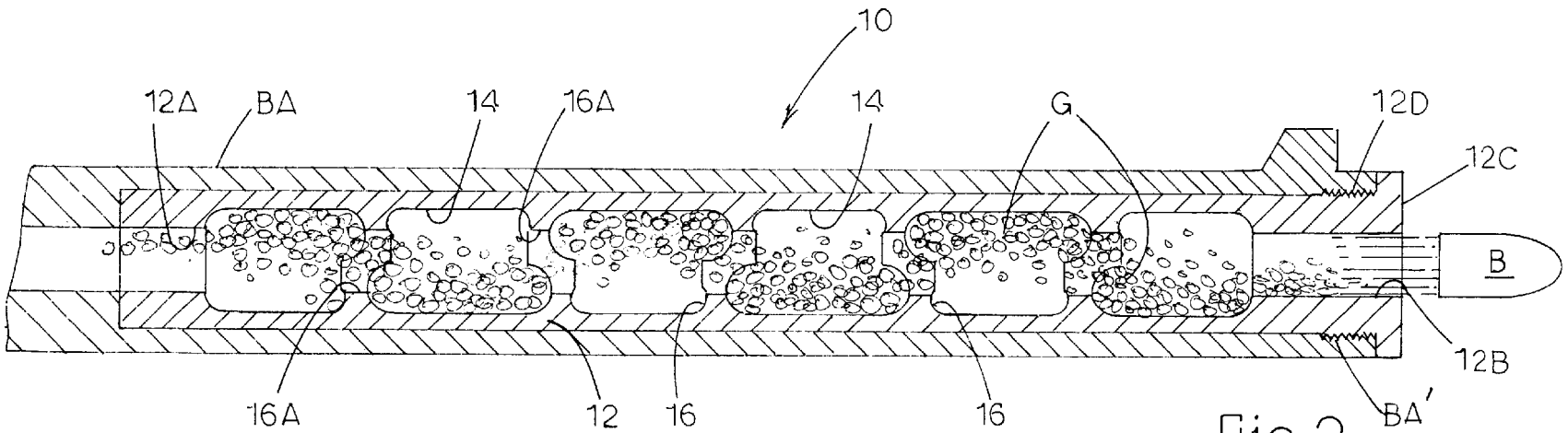
FIG. 2 is a vertical cross-sectional view of the invention shown in FIG. 1 mounted in the end of a firearm barrel.

With reference now to FIGS. 1–4 of the drawings, FIGS. 1–3 show a first embodiment of the invention that is generally designated 10. Noise and recoil suppressor 10 is a unitary element, preferably formed of titanium, and comprises cylindrical body 12 preferably having a diameter between about 0.50 to 4.0 inches and a length of between about 1.50 to 24 inches. Suppressor 10 includes a plurality of spaced-apart chambers 14 along the length of suppressor 10 that are best seen in FIGS. 1 and 2. Chambers 14 are most suitably cross-drilled through the cylindrical body of suppressor 10 with a conventional cross drilling machine, and the chambers most suitably define a substantially T-shaped cross section when suppressor 10 is viewed in side elevation. Chambers 14 are provided along the length of cylindrical body 12 of suppressor 10 wherein chambers 12 alternate between upright and inverted orientation for reasons that will be described hereinafter. Cylindrical body 12 further includes an aperture 12A at the innermost end thereof through which a bullet and exhausting gases can pass from a firearm barrel into first chamber 14 and a second aperture 12B at the outermost end thereof through which a bullet can exit last chamber 14 of noise and recoil suppressor 10.

As can further be seen in the drawings, the plurality of chambers 14 (e.g., six as shown in FIGS. 1–3) define dividing walls 16 between adjacent chambers 14. Dividing walls 16 (e.g., five dividing walls 16 for the six chambers 14) each include an aperture 16A therein which are positioned substantially in alignment with apertures 12A and 12B at each end of suppressor 10 and in substantial co-linear alignment with the longitudinal axis of noise and recoil suppressor 10. Although applicants contemplate that apertures 12A, 12B, and 16A provided, respectively, at opposing ends and along the length of suppressor 10 can be of other dimensions, most suitably the apertures each define a diameter between about 0.26 and 0.75 inches.

Again with reference to FIGS. 1–3 of the drawings, it will be understood that a flange 12C is found at the outermost end of suppressor 10 (containing aperture 12B in the central portion thereof) and a plurality of external screw threads 12D are provided immediately behind flange 12C on cylindrical body 12 to facilitate threadable securement of noise and recoil suppressor 10 within a gun barrel in a manner which will now be described.

As with prior art noise and recoil suppressors or "silencers", suppressor 10 is configured to slow down and break-up exhausting gases G from the discharge propelling cartridge bullet B through the barrel of a firearm so as to reduce the noise resulting from the entrance of the discharging gases or blast into the atmosphere. As will be appreciated with reference to the drawings, chambers 14 of suppressor 10 are configured so as to retard and urge the exhausting gases G through a sinuous (and time consuming) pathway within suppressor 10 in order to reduce noise and recoil of a firearm in which the device is utilized. The unitary nature of suppressor 10 and its titanium construction provides for a strong and low maintenance noise and recoil suppressor when utilized in the manner described herein.

Applicants contemplate that a firearm (which can be rifle or a pistol) will have the terminal portion of the original barrel BA milled or drilled-out to an enlarged diameter that exceeds the diameter of the bullet pathway within the barrel (see FIG. 2). Although many different diameters are contemplated as being possible with applicants' invention, applicants believe that the internal diameter of the drilled end of barrel BA will normally be between 0.50 to 4.0 inches (0.65 to 4.5 inches outside barrel diameter). This, of course, depends upon a number of factors including the size of the firearm and the ammunition being discharged by the firearm. Applicants presently contemplate that suppressor 10 could be used with different size firearms ranging from a 22 caliber rifle to a 50 caliber rifle and with handguns ranging from a 22 caliber handgun to a 50 caliber handgun.

Once firearm barrel BA has been suitably machined or drilled-out to a desired diameter and for a desired length (typically about 6.0 to 24.0 inches for a rifle and about 2.0 to 12.0 inches for a pistol), the outermost end of barrel BA is then internally threaded with screw threads BA'. Internal screw threads BA' are sized so as to threadingly engage external screw threads 12D of suppressor 10. Thus, once barrel BA of a firearm has been suitably drilled-out and internally threaded at its outermost end, barrel BA is ready to receive suppressor 10 internally therein so as to be non-observable to the user or anyone observing the firearm or its use.

Figure 3A:
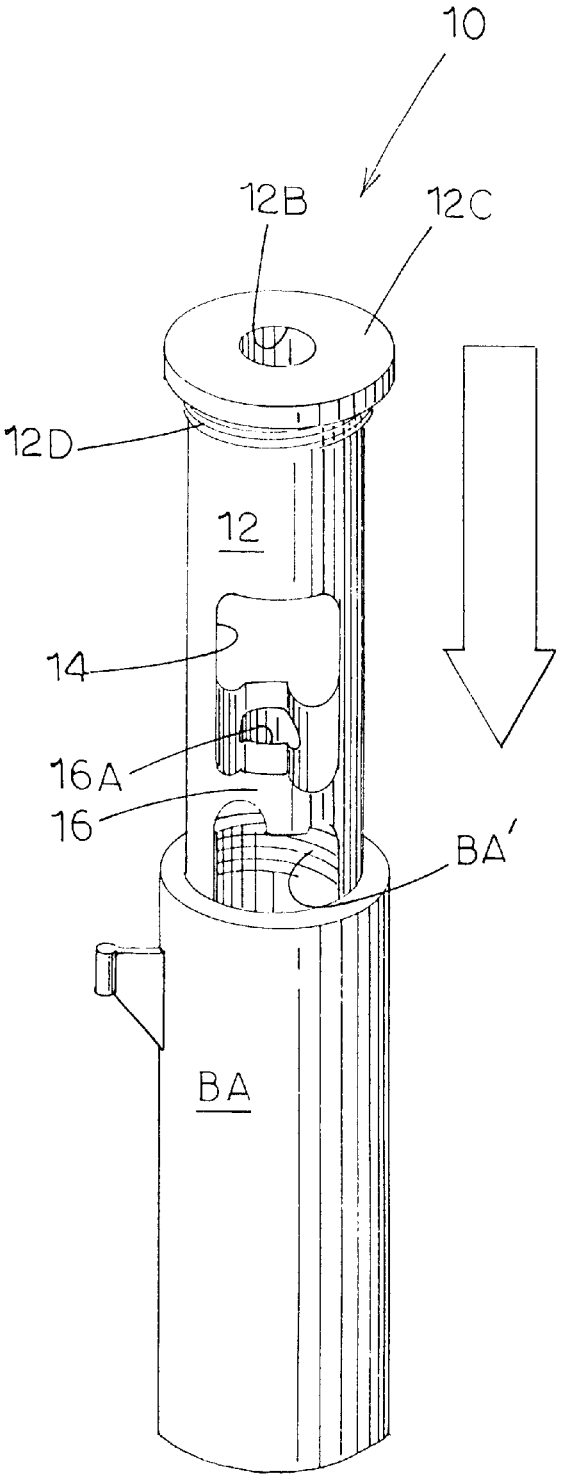
FIG. 3A is a perspective view of the noise and recoil suppressor of the present invention being introduced into the end of a firearm barrel.
Figure 3B:
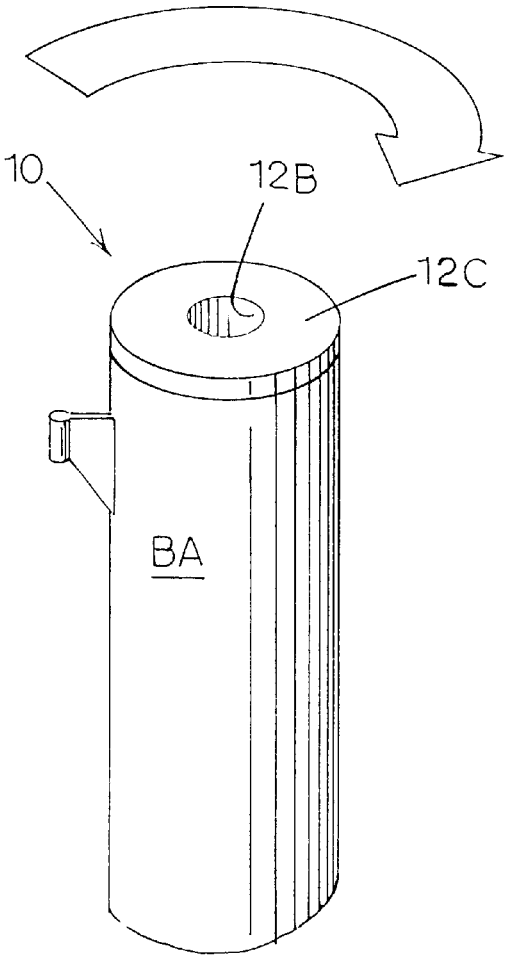
FIG. 3B is a perspective view of the noise and recoil suppressor of the present invention fully inserted and threadably secured within the end of a firearm barrel.

As best seen in FIGS. 3A, 3B, installation of suppressor 10 into barrel BA of a firearm entails slidably inserting suppressor 10 into the barrel until substantially fully inserted, and then rotating flange 12C clockwise so as to tighten threads 12D of cylindrical body 12 with internal threads BA' of barrel BA. Once suppressor 10 has been suitably threadably tightened into barrel BA of a firearm, flange 12C will serve as the endcap of firearm barrel BA.

Figure 3C:
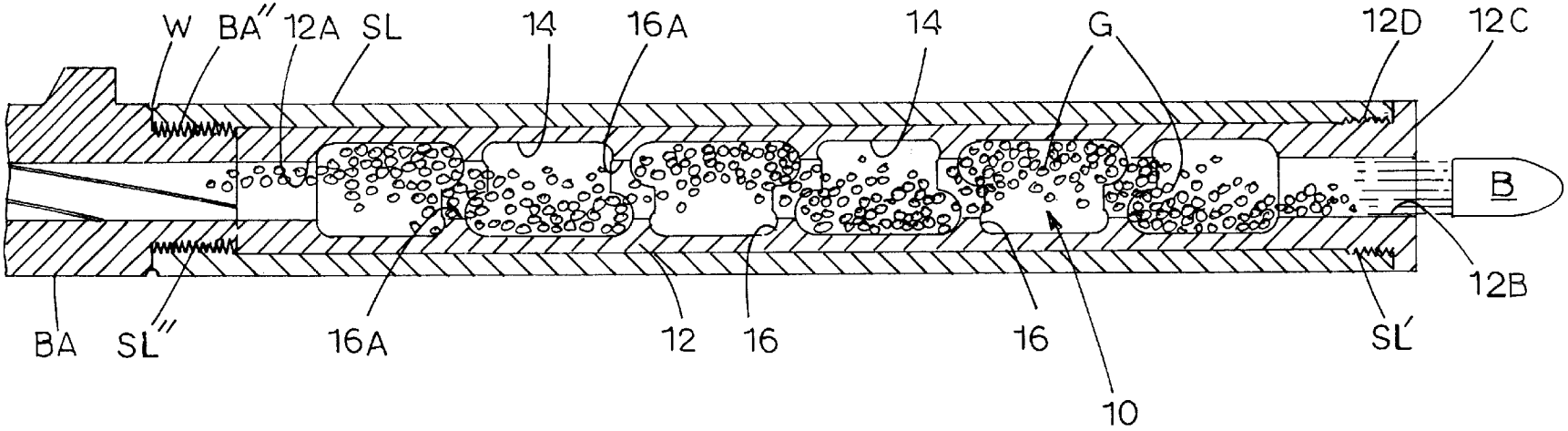
FIG. 3C is a side elevation view of a variation of the noise and recoil suppressor of the present invention wherein the device is screwed onto and welded to the existing barrel.

Referring to FIG. 3C, as an alternative to drilling out the end of a firearm barrel BA, applicants also contemplate that suppressor 10 can be threadably secured within a concentric sleeve SL (formed of a suitable metal such as steel) that has the same diameter as barrel BA and is formed to be threadably secured thereto. The outer end of sleeve SL is internally threaded with screw threads SL' to receive flange 12C of suppressor 10 and the inner end of sleeve SL is internally threaded with screw threads SL" to receive screw threads BA" provided around the reduced diameter end of firearm barrel BA. After being threadably secured together, barrel BA and sleeve SL surrounding suppressor 10 are formed into a single barrel (per ATF regulations and definitions) with a weld joint W. The resulting combination provides a noise and recoil suppressor on a firearm that cannot be seen by an observer of the firearm.

Figure 4:
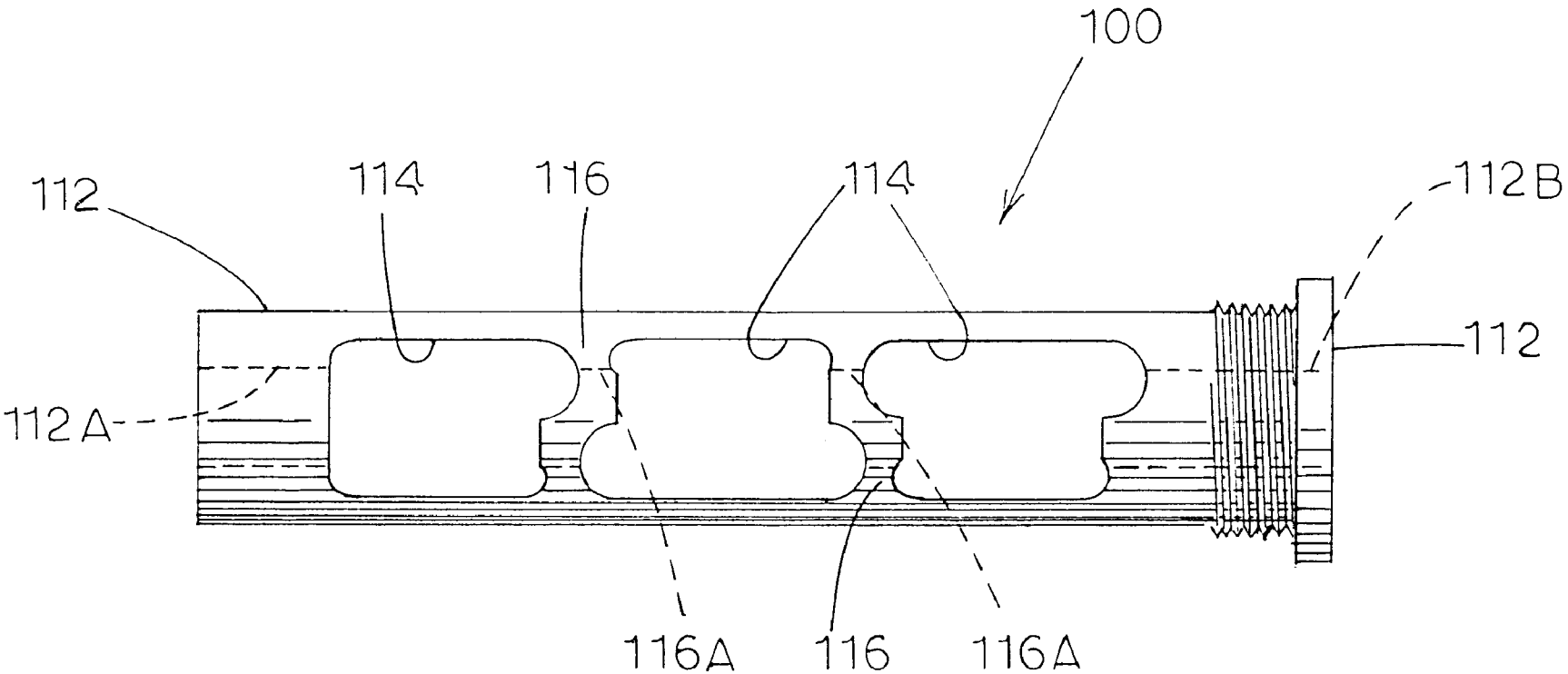
FIG. 4 is a side elevation view of a second embodiment of the suppressor of the present invention wherein the device primarily functions as a recoil suppressor for a firearm.

Referring finally to FIG. 4 of the drawings, a second embodiment of the invention is shown. The suppressor, generally indicated as 100, is also formed of cylindrical body 112, apertures 112A and 112B at opposing ends of cylindrical body 112, chambers 116 defining apertures 116A therein and flange 112C and external threads 12D immediately therebehind. Suppressor 100 is similar to the first embodiment of the invention, suppressor 10, except that it is of a smaller length and would typically include fewer chambers 114 therethrough (e.g., three chambers in FIG. 4). The reduced length of suppressor 10 is intended to provide a device that serves primarily to reduce recoil and does not significantly reduce the noise of the firearm discharge.

As with respect to the first embodiment of the drawing, it is highly desirable in many circumstances for a recoil suppressor not to be visible to a user or observer of a firearm. Thus, suppressor 100 is constructed similarly to suppressor 10 except for a reduction in length. It is believed that suppressor 100 most suitably is constructed with the same cylindrical body diameter and apertures diameter as suppressor 10 and a length of between about 1.0 to 12.0 inches. The device can also be used with firearms of many types including rifles and pistols. A firearm barrel is also suitably milled out to an enhanced diameter in order to receive suppressor 100 therein as was described with reference to the first embodiment of the invention, suppressor 10, hereinabove. Suppressor 100 can also be attached to an existing barrel in the same manner as disclosed above for noise and recoil suppressor 10 (as shown in FIG. 3C).

From the foregoing description, operation of both embodiments of the invention should now be fully understandable and appreciated. Suppressors 10 and 100 are usable on many different types of firearms for controlling noise and recoil or recoil, respectively. Applicants contemplate that the device is a major advancement in the field of noise and recoil suppressors and overcomes many shortcomings of such prior art devices known to those skilled in the art.

It will be understood that various details of the invention may be changed without departing from the scope of the invention. Furthermore, the foregoing description is for the purpose of illustration only, and not for the purpose of limitation—the invention being defined by the claims.

What is claimed is:

1. In combination a gun barrel and a noise and recoil suppressor positioned within the bored out end of the otherwise conventional gun barrel, said suppressor comprising a bullet entry end, a bullet exit end and a cylindrical body having a plurality of chambers spaced along the longitudinal direction of said cylindrical body, and said plurality of chambers being shaped so as to slow passage of the exhausting gases therethrough, said suppressor being a unitary element and said plurality of chambers being formed in said cylindrical body by cross drilling said cylindrical body.

2. In combination (1) a gun barrel and (2) a noise and recoil suppressor positioned within a bored-out length at the distal end of the otherwise conventional gun barrel, wherein said suppressor comprises a bullet entry end, a bullet exit end and a cylindrical body having a plurality of chambers extending transversely therethrough so as to define a dividing wall between adjacent chambers that are spaced along the longitudinal direction of said cylindrical body, said bullet entry end and exit end and said dividing walls having apertures therein through which a bullet and exhausting gases can pass, and said plurality of chambers being shaped so as to slow passage of the exhausting gases therethrough, said suppressor being a unitary element and said plurality of chambers being formed in said cylindrical body by cross drilling said cylindrical body.

3. In combination a gun barrel and a noise and recoil suppressor positioned within the end of the otherwise conventional gun barrel, wherein said suppressor is a unitary element comprising a bullet entry end, a bullet exit end and a cylindrical body having a plurality of chambers that are spaced along the longitudinal direction of said cylindrical body, and said plurality of chambers being shaped so as to slow passage of the exhausting gases therethrough, said suppressor being a unitary element and said plurality of chambers being formed in said cylindrical body by cross drilling said cylindrical body.

* * * * *